US005220819A

United States Patent [19]

Scheib et al.

[11] Patent Number: 5,220,819

[45] Date of Patent: Jun. 22, 1993

[54] ENTRY GUIDE FOR STRIP MILL

[75] Inventors: William R. Scheib, Seven Hills; William G. Sherwood; Paul R. Sutherin, both of Salem; Raj N. Varadarajulu, Strongsville, all of Ohio

[73] Assignee: Production Experts, Inc., Cleveland, Ohio

[21] Appl. No.: 897,240

[22] Filed: Jun. 11, 1992

[51] Int. Cl.[5] ..... B21B 39/16

[52] U.S. Cl. ..... 72/251; 72/428

[58] Field of Search ..... 72/250, 251, 428; 100/173; 226/185, 189; 198/836.3, 836.4

[56] References Cited

U.S. PATENT DOCUMENTS

| | | | |
|---|---|---|---|
| 1,821,664 | 9/1931 | Peiler | 226/189 |
| 1,973,458 | 9/1934 | Yoder | 72/428 |
| 2,402,546 | 6/1946 | Gaykowski . | |
| 2,651,955 | 9/1953 | Fisher | 72/250 |
| 3,071,032 | 1/1963 | Teplitz | 72/428 |
| 3,740,989 | 6/1973 | Petros | 72/250 |

FOREIGN PATENT DOCUMENTS

| | | | |
|---|---|---|---|
| 0150711 | 7/1986 | Japan | 72/251 |
| 1047566 | 10/1983 | U.S.S.R. | 72/251 |
| 881671 | 11/1961 | United Kingdom | 72/250 |

*Primary Examiner*—Lowell A. Larson
*Assistant Examiner*—Thomas C. Schoeffler
*Attorney, Agent, or Firm*—Pearne, Gordon, McCoy & Granger

[57] ABSTRACT

A mechanism for feeding strip material into the nip between a pair of strip mill rollers includes opposed guides for engaging and capturing the edges of the material being fed into the nip. Each guide has a side wall, a top plate and a bottom plate that together define a tapered channel. The wide end or throat of the channel initially receives the material, while the small end of the channel guides the material into the adjacent nip. The guides are movable toward and away from each other to accommodate strip materials of different widths. Each guide journals a series of vertically extending rollers of decreasing lengths upon which the associated side edge of the strip material sequentially rides as it moves toward the nip. The lengths of the rollers substantially exceed the expected thicknesses of the strip material so that the lower ends of the rollers wear at a faster rate then their upper ends. When the wear on the lower ends of the rollers has progressed to a predetermined degree, the rollers can be easily inverted to permit continued operation of the mechanism.

8 Claims, 7 Drawing Sheets

ENTRY GUIDE FOR STRIP MILL

BACKGROUND OF THE INVENTION

The present invention relates in general to web or strip material handling mechanisms, and more particularly to an entry guide for feeding strip material into the nip or bite area between a pair of mill rollers.

Strip mill entry guides are known in the art, as evidenced by U.S. Pat. 2,402,546 and 3,740,989. The function of entry guides is to control and properly position strip material as it is fed between an opposed pair of mill rolls or rollers wherein the strip is worked. For example, several stands or sets of mill rollers are used together to sequentially reduce relatively thick slab steel into relatively thin strip steel that is widely used as sheet metal in automotive, appliance, and other applications. When the slab steel is rolled at high temperature, the process is known as "hot milling", while the process of rolling lower temperature slab steel is known as "cold milling". While the present invention is pertinent to "cold milling" and other strip handling processes, its primary advantages are found in "hot milling" applications.

The "hot milling" of slab steel through a series of stands of mill rollers is a complex process requiring that the sets of rollers operate at different speeds, roller pressures and the like due to the gradual thinning and lengthening of the high temperature steel strip being rolled. Each stand of mill rollers requires an entry guide mechanism to effectively transfer the strip material to it from an adjacent set of rollers. The entry guide mechanism must serve two primary functions, i namely feeding or threading the leading edge of the strip into the nip of the associated mill rollers, and then maintaining the strip of material in proper position as its length continues through the nip of the associated rollers. Ideally, the entry guide mechanism for each stand should be generally identical to permit interchangeability and facilitate maintenance. By being generally identical to each other, each entry guide mechanism must be able to accommodate strip material traveling at different speeds and having different thicknesses and thus masses. Also, the entry guide mechanism must be of a design and construction that is rugged and user accommodating so as to provide for reliable operation under adverse conditions common in a "hot milling" environment.

SUMMARY OF THE INVENTION

In accordance with the present invention, a frame structure is provided that is movable toward and away from an associated stand of mill rollers. A pair of opposed horizontally extending guides providing a vertically tapering channel are mounted on the frame and engage and capture the side edges of the strip material as it moves between the guides toward the nip of the associated mill rollers.

A series of vertical axis guide rollers extend along the horizontal length of each guide, each roller having an upper portion and a lower portion. The side edges of the strip material engage and ride primarily on the lower portions of the rollers since the vertical lengths of the rollers are substantially greater than the expected thickness of the strip material, whereby the lower roller portions will wear faster than their upper portions. When wear of the lower roller portions has proceeded to a predetermined degree, the rollers can be easily inverted wherein primarily the former upper roller portions now bear against and guide the strip material.

Preferably, spray means such as nozzles apply cooling liquid to the lower portions of the rollers to lengthen their service life. Also, the guide rollers farthest from the nip of the mill rollers are of a diameter larger than those closest to the nip so as to better absorb higher impact forces caused by the leading edge of the strip as it first engages the large diameter rollers during an initial threading operation. Also, the guides are preferably movable toward and away from each other to accommodate strip material of varying widths.

Thus, the strip mill entry guide in accordance with the invention has proven to be highly rugged, adaptable and reliable without attendant high cost and complexity.

BRIEF DESCRIPTION OF THE DRAWINGS

A fuller understanding of the invention may be had by referring to the following description and claims taken in conjunction with the accompanying drawings, wherein:

DETAILED DESCRIPTION OF THE PREFERRED EMBODIMENT

Figure 1:
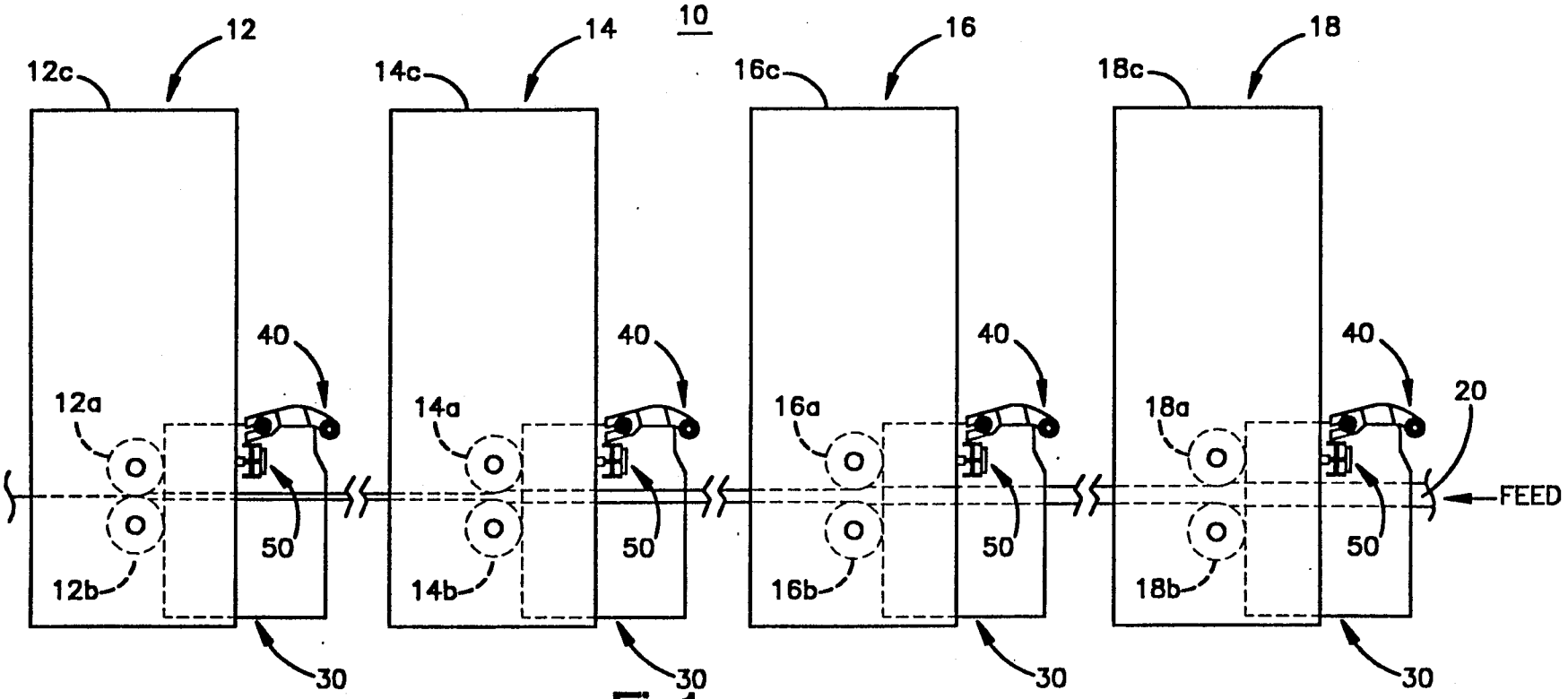
FIG. 1 schematically illustrates the application of the present invention to a strip milling operation.

With reference to FIG. 1, a strip rolling mill 10 is schematically illustrated in a simplified manner to demonstrate the application of the present invention wherein a relatively thick strip or slab 20 of high temperature steel is fed into the mill 10, where it is worked and gradually reduced primarily in thickness to provide sheet metal. Such milling operation in general being well known in the art. As illustrated in FIG. 1, the mill 10 includes four rolling mill stands 12, 14, 16 13 and 18, each having a pair of working rolls 12*a*–12*b*, 14*a*–14*b*, 16*a*–16*b* and 18*a*–18*b*. The rotational axes of the roller pairs are opposed to each other and on respective sides of the strip material 20 wherein the material, as it is fed between the nip or bite area between the rollers, can be worked and pressed by the rollers to, in effect, be extruded primarily in a lengthwise dimension, thereby reducing the thickness of the material in a progressive and gradual manner, as illustrated. As is known in the art, to initiate the operation of the rolling mill 10 on the sheet material 20, the leading edge of the material is fed in the direction indicated sequentially, first through mill stand 18, then 16, then 14, and finally mill stand 12. This process can continue until the desired thickness of the material has been obtained by appropriate control of the mill roll pairs.

With further reference to FIG. 1, a rolling mill entry guide 30 in accordance with the present invention is provided for each rolling mill stand 12, 14, 16 and 18. Each rolling mill entry guide 30 feeds the associated strip material 20 into the nip between its associated pair of strip mill rollers by engaging and capturing the edges of the material being fed into the nip of the associated rollers. It is to be noted that the primary function of each guide 30 is to capture and in effect thread the incoming leading edge of the strip material and then feed it into the nip area of its associated mill rollers. Once the threading operation of the material 20 has been completed as illustrated in FIG. 1, the guides 30 assist in maintaining proper position and alignment of the material as it moves through the strip rolling mill 10.

As shown in FIG. 1, each rolling mill entry guide 30 includes a conventional knockdown roll mechanism 40 to guide the leading edge of the web material 20 into a throat area of the guide 30 in a manner to be subsequently illustrated. As is well recognized in the art, as the leading edge of the material 20 exits an associated pair of rollers, it does not necessarily travel in a linear direction along the path shown in FIG. 1, but rather can move up and down, vertically and side to side as a result of it being extruded from the nip area of the rollers it has just exited. It is the function of the guide mechanism 30 to capture and guide the material into the next set of rollers and the knockdown roll mechanism 40 assists in the guiding operation.

In a manner to be subsequently illustrated, each rolling mill entry guide 30 can move toward and away from its associated pair of mill rollers so as to allow access to both the entry guide 30 and the nip area of the mill rollers for maintenance purposes and the like. It is important that movement of the guides 30 toward their associated roller pairs be limited and such limiting of movement is provided by manually adjustable stop members 50 which engage and abut the frames 12*c*, 14*c*, 16*c* and 18*c* of the rolling mill stands. The detailed operation and structure of the manually adjustable stop members will be subsequently illustrated. Thus it can be seen, that the strip rolling mill 10 with its rolling mill stands 12, 14, 16 and 18 and its associated rolling mill entry guides 30, cooperate to primarily reduce the thickness, and thus increase the length, of the metal slab or strip material. It should be noted that the material 20 is worked at high temperature in the order of 2000° F. to lessen the mechanical force required to work it. However, the high temperature of the strip material being worked necessitates that the entry guide 30 be designed so as to be able to tolerate such high temperatures and the caustic environment resulting therefrom.

Figure 2:
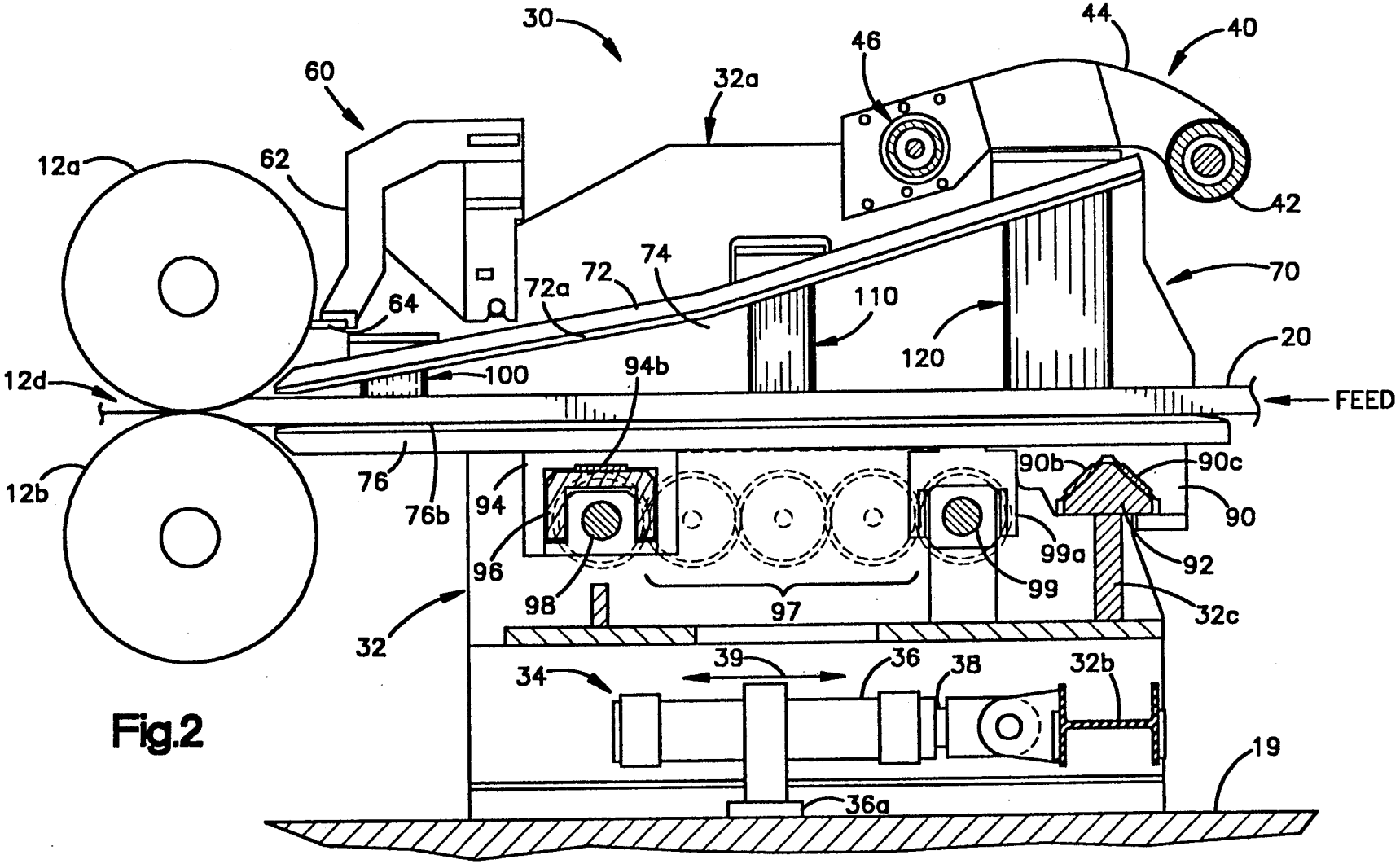
FIG. 2 is an elevation view in cross section of a strip mill entry guide in accordance with the invention.

Turning to FIG. 2 of the drawings, a more detailed illustration of a rolling mill entry guide is shown by an elevation view in cross section. For purposes of simplification, the rolling mill entry guide 30 associated with rolling mill stand 12 of FIG. 1 has been illustrated, it being recognized that the other rolling mill stands 14, 16 and 18 are equipped with the same rolling mill entry guide 30 illustrated in FIG. 2.

The rolling mill entry guide 30 in accordance with the present invention includes a frame 32 which is supported at its lower end by the floor 19 of the rolling mill in a manner to be more fully illustrated. An upper end 32*a* of the frame 32 supports at its right end, as illustrated, the earlier noted knockdown roll mechanism 40 which includes a knockdown roll 42 engageable with an incoming leading edge of the strip material 20. The knockdown roll 42 is supported at one end of an arm member 44 having its other end fixedly mounted to the upper end of the frame 32*a* by a member 46. The upper end 32*a* of the frame 30 also supports at its left end, a roll wiper mechanism 60 of conventional design which includes a roll wiper support arm 62 which at its distal end supports a wiper blade 64 engageable with the outer cylindrical surface of the upper mill roller 12*a* so as to wipe it clean during a rolling operation. At the lower end of the frame 32, a lower frame cross member 32*b* has attached to it one end of a hydraulic actuator 34. The end of the hydraulic actuator 34 attached to the cross member 32*b* is a piston portion 38 that reciprocates into and out of an associated cylinder portion 36 which includes a base element 36*a* fixed to the floor 19 of the mill, as illustrated. Upon operation of the actuator 34, the rolling mill entry guide 30 can move back and forth, as illustrated by arrow 39 so as to move the entry guide 30 either away from or toward the pair of mill rollers 9 12*a*, 12*b*. As noted earlier with regard to FIG. 1, the extent of movement of the entry guide 30 toward the mill rollers 12*b* is limited by engagement of the stop mechanisms 50 (see FIGS. 1, 3) with the associated frame of the rolling mill, which will be more fully described hereafter.

Figure 3:
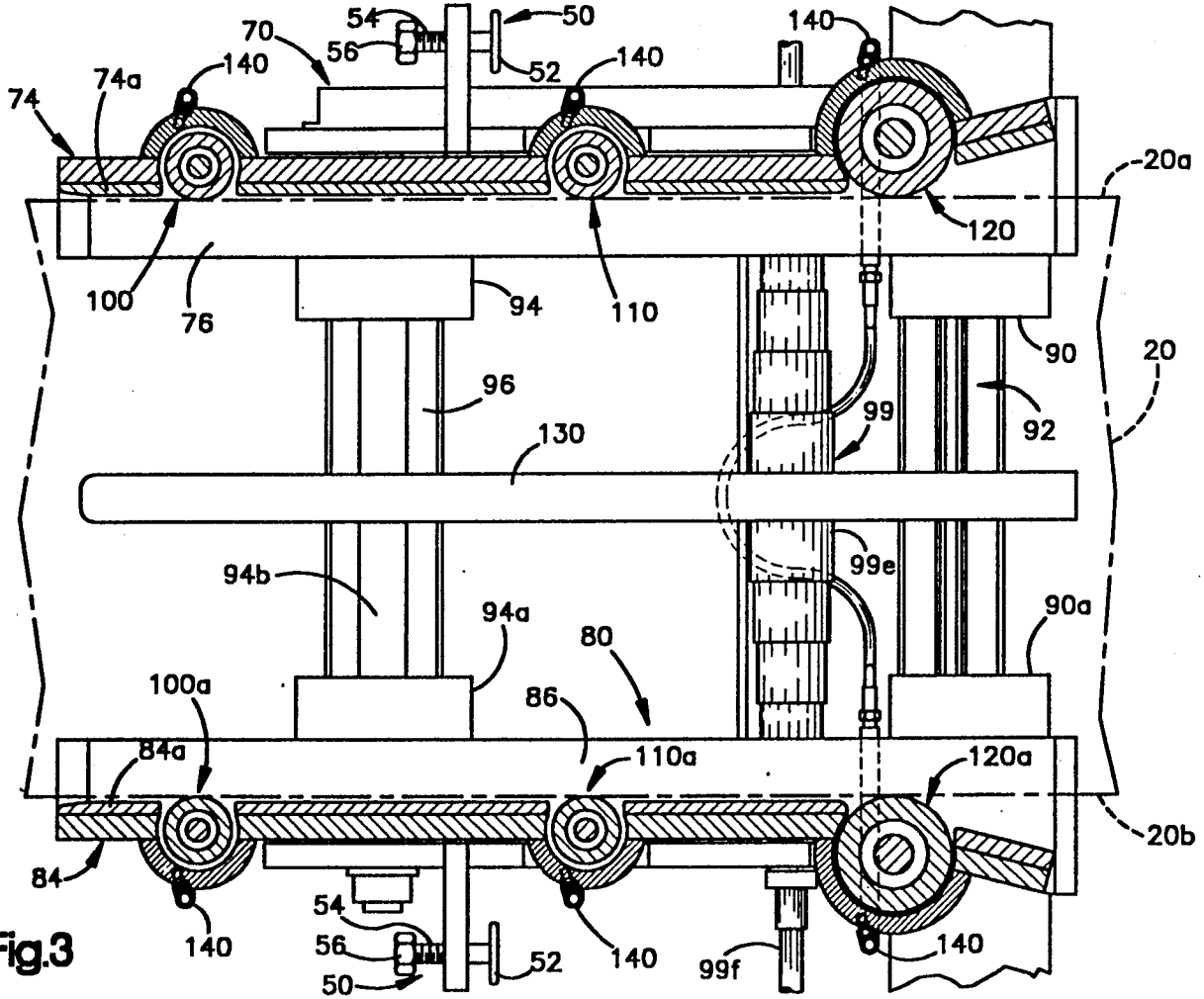
FIG. 3 is a plan view in cross section of the strip mill entry guide.

With continued reference to FIG. 2 and with reference also to FIG. 3, which is a plan view in cross section of the entry guide 30, a better understanding of the structure and operation of the entry guide can be had.

As referenced to the direction of feed indicated in FIGS. 2 and 3, a pair of opposed, horizontally extending guides 70, 80 are mounted on the frame 32 for engaging and capturing the vertical side edges of the strip material 20. The guides 70, 80 define a horizontally extending channel that vertically tapers as said material moves through the channel toward the nip area 12*d* between the mill rollers 12*a*, 12*b*. The guide 70 captures and directs the right edge 20*a* of the material 20 while the guide 80 captures and directs the left 20*b* edge of the material 20 toward the associated mill rollers. The right edge guide 70 includes a top plate 72, a vertically, downwardly extending side wall 74 and bottom plate 76. In a similar manner, the left edge guide 80 includes a top plate 82 (See FIG. 4), a side wall 84 and a bottom plate 86.

Figure 6:
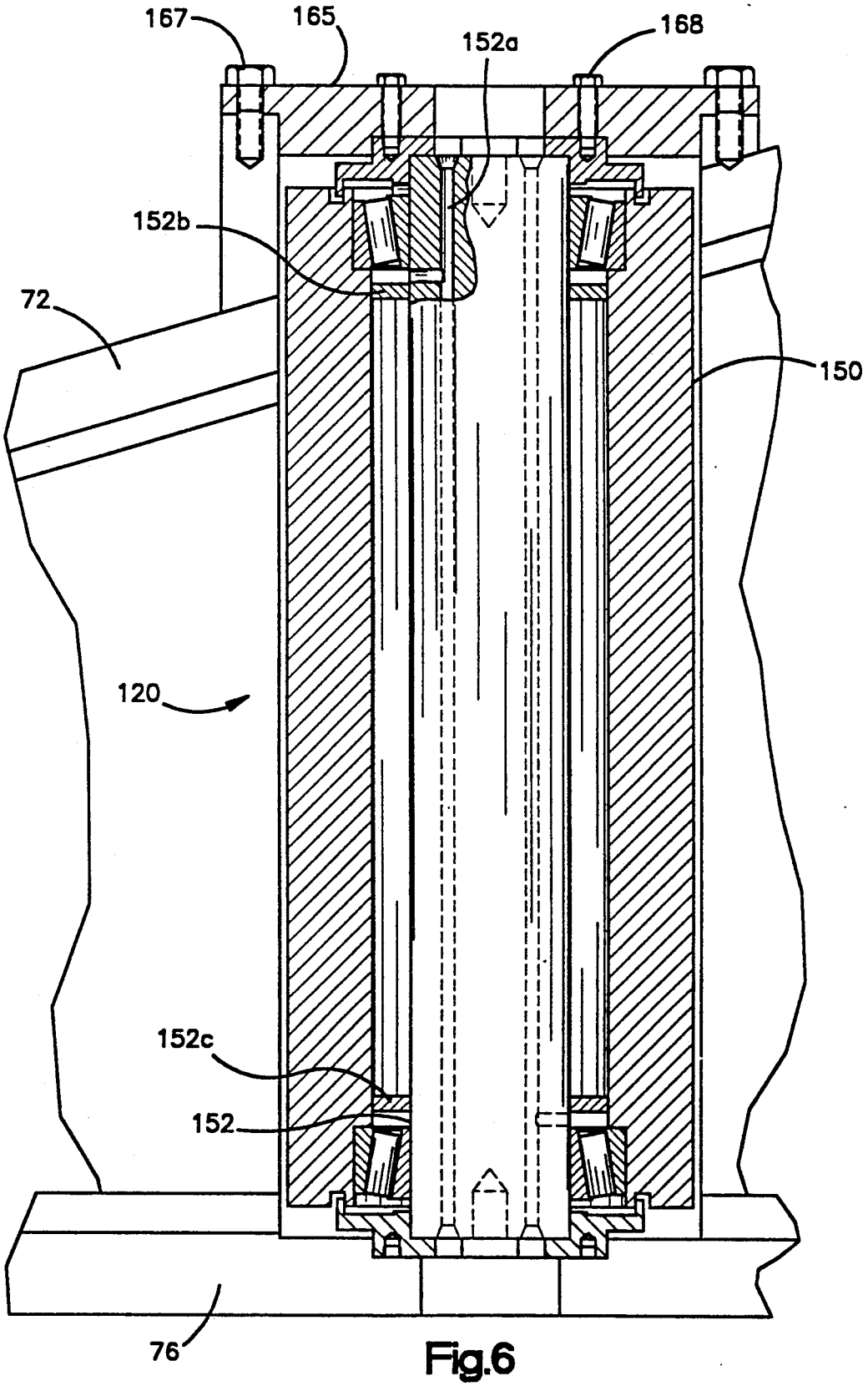
FIG. 6 is an elevation view in cross section of a roller member used in the guide element of FIG. 5.
Figure 7:
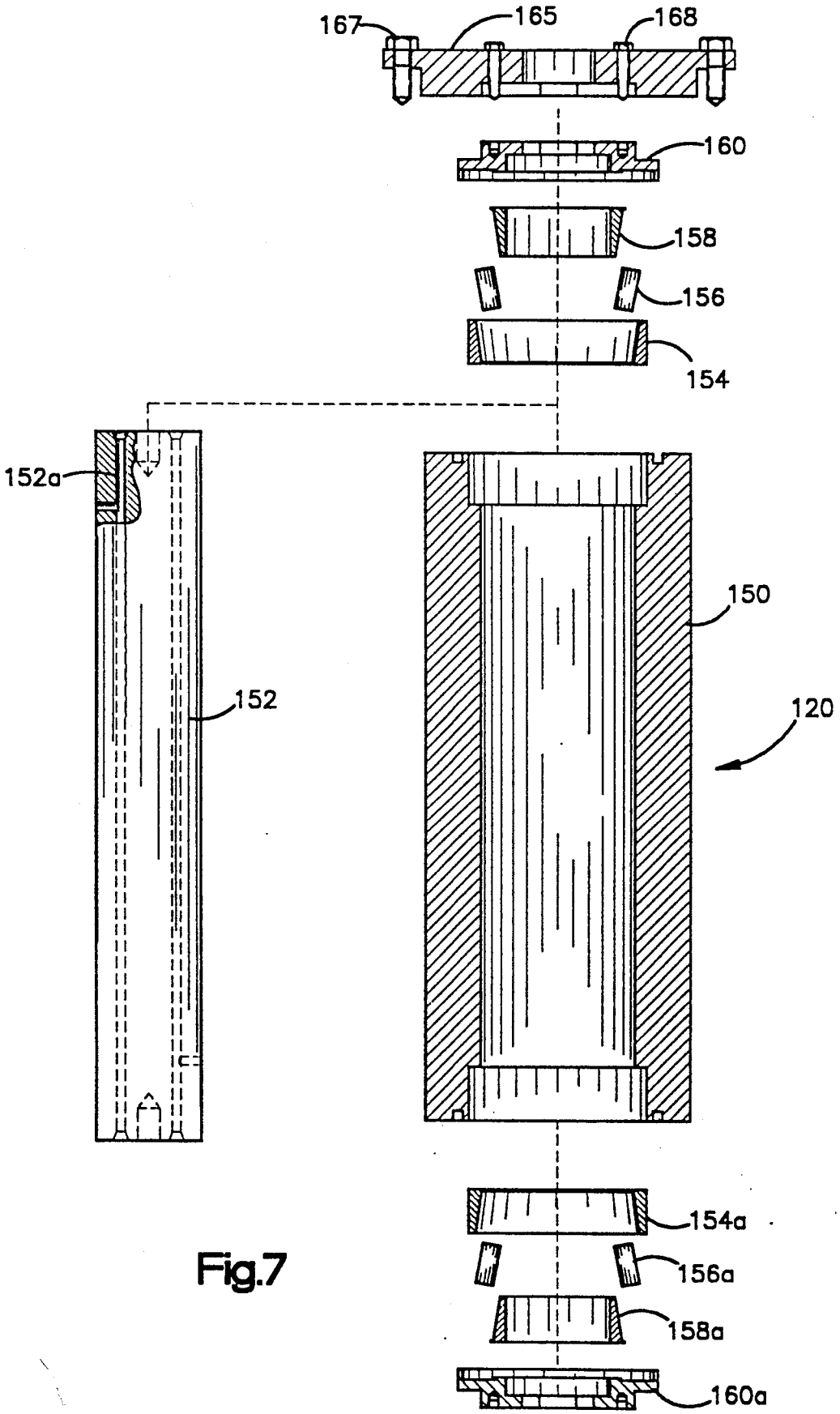
FIG. 7 is an exploded view of the roller element of FIG. 6.

As shown most clearly in FIG. 2, the top plate 72 and bottom plate 76 vertically taper away from each other as they extend away from the nip 12*d*, the bottom plate 76 being generally horizontal while the top plate 72 extends generally upwardly as its length progresses from the nip 12*d*. Likewise, the top plate 82 and the bottom plate 86 vertically taper away from each other as they extend away from the nip 12*d*. The side wall 74 includes along its length a series of vertical axis rollers 100, 110, 120 that extend along the horizontal length of the guide 70. In a similar manner, the guide 80 includes a corresponding set of rollers 100*a*, 110*a* and 120*a* that are generally identical in dimension and structure to the rollers 100, 110, 120 forming a part of the right edge guide 70. As best shown in FIG. 2, the vertical lengths of the rollers are substantially greater than the expected thickness of the material 20 wherein during 3) of the material 20 ride on the lower portions of the rollers whose services extend for example, ¼ inch above the planes of the side walls 74, 84. The detailed structure of the series of vertical axis rollers 100, 110, 120 and 100*a*, 110*a*, 120*a* will be discussed in greater detail in connection with FIGS. 5, 6 and 7.

Figure 4:
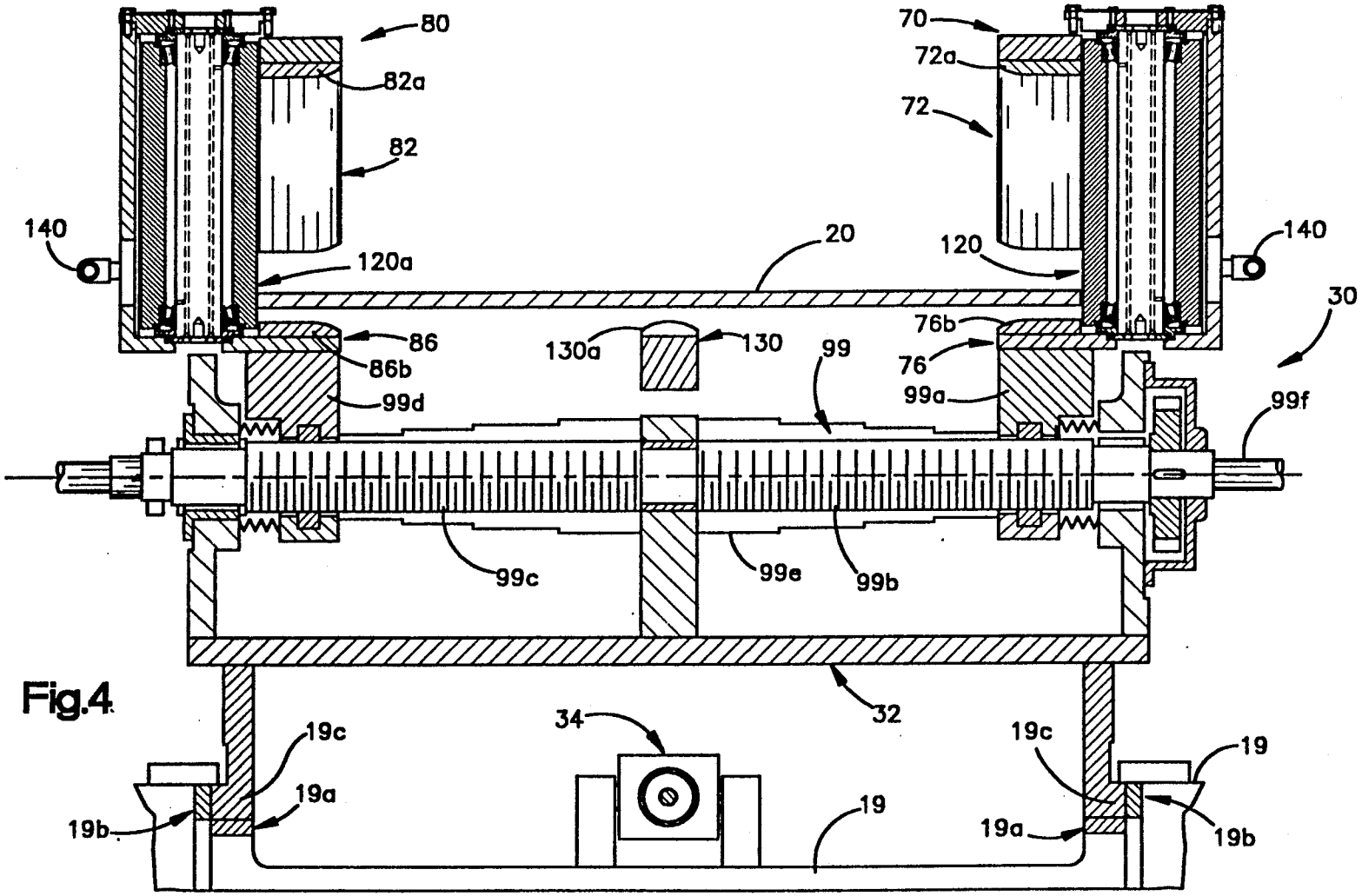
FIG. 4 is a front end view in cross section of the strip mill entry guide.

With further reference to FIGS. 2 and 3 and also with reference to FIG. 4 which is front end view in cross section of the strip mill entry guide, it is preferable that both the right edge guide 70 and the left edge guide 80 be lined with abrasion-resistant material such as type 4340 Alloy Steel Liners hardened to approximately 45 $R_c$ so as to minimize wear of the guides 70, 80 caused by engagement with the edges of the strip material during threading operations as discussed earlier. The liners for the guides are machined with rounded and tapered edges where possible so as to not catch on the material 20 moving through them. With reference to FIGS. 2, 3 and 4, the top plate 72 has fastened to its lower side, an abrasion-resistant guide 72*a*. In a similar manner, the side wall 74 is provided with an abrasion-resistant lining 74*a* while the lower plate 76 of the guide 70 is provided on its upper surface with an abrasion-resistant lining 76*b*. In a similar manner, guide 80 includes abrasion-resistant linings 82*a*, 84*a* and 86*b*.

The guides 70, 80 are movable toward and away from each other to accommodate different widths of the material. Such movement toward and away from each other is provided by a screw mechanism that will now be discussed.

The guide 70 is supported upon a front carriage 90 and a rear carriage 94. The carriages 90, 94 in turn are supported on and ride back and forth upon, respectively, a front carriage support rail or way 92 and a rear carriage support rail or way 96. In a similar manner, the guide 80 is supported upon its associated front carriage 90*a* and rear carriage 94*a* both of which ride on the ways 92, 96. With specific reference to FIG. 2, way 92 is of generally triangular shape so as to accommodate both vertical and horizontal forces put on it by the carriage 90. The way 92 is supported by a frame cross member 32*c* as illustrated. The carriage 90 includes a pair of bearing pads 90*b*, 90*c* that ride on the upper surface of the way 92. As also shown in FIG. 2, the rear carriage support rail or way 96 is of a generally inverted channel shape and provides a top surface upon which a bearing pad element 94*b* rides. The ends of the way 96 are fixed and mounted to the frame 32. Thus, the carriages 90, 94 and 90*a* and 94*a* ride on the ways 92, 96 and move toward each other or away from each other depending upon the width of the strip material 20 being worked.

With specific reference to FIGS. 2 and 4, the noted movement of the guides 70, 80 toward and away from each other is effected by means of a pair of rotating screw drives 98, 99. The screw drive 98 is located within the way 96, while the screw drive 99 is positioned toward the front or feed end of the guide 30 is located adjacent to the way 92, as illustrated. With specific reference to FIG. 4, the screw drive 99 is illustrated in greater detail, it being recognized that the drive 98 is of generally similar construction and function. As shown in FIG. 4, the screw drive 99 extends transversely across the extent of the guide 30 and is rotatably supported at its middle and at both ends by suitable bearing structures, which are, in turn, supported by the frame of the guide. The screw drive 99 threadingly engages a right edge guide follower 99*a* fixed to the guide 70 as illustrated, while a left edge guide follower 99*d* is fixed to the left guide 80. The front screw drive 99 is provided at its left end portion as viewed in FIG. 4, with a left-hand thread segment 99*c* while its right-hand portion is provided with a right-hand threaded portion 99*b*. Upon rotation of the shaft end 99*f* of the screw drive 99 due to the counterthreaded portions 99*c*, 99*b*, the followers 99*a*, 99*d* will move either toward each other or away from each other. Rotation of the screw actuator 99 by means of the shaft 99*f* is accomplished by a suitable electric motor (not shown) mounted to and supported by a separate frame (not shown). To keep dirt and debris from interfering with operation of the screw actuator 99, a suitable cover 99*e* is provided that can expand and collapse in length in a manner known in the art. As shown in FIG. 2, the screw actuator 98 is drivingly connected to the actuator 99 via an appropriate gear drive train 97 schematically illustrated. Thus, rotation of the shaft 98 and 99 occurs simultaneously because of the their interconnection via the gear train 97. The screw actuator 98 is similar in design to the earlier discussed actuator 99 illustrated in FIG. 4 but is contained within the way 96, as illustrated, so as to be protected from dirt and debris. As shown in FIG. 3, the carriages 94, 94*a* include at their lower, under ends follower portions that respectively ride on counterthreaded halves of the screw actuator 98 in a manner similar to followers 99*a*, 99*d* (see FIG. 4) discussed earlier.

Thus, it can be seen that by appropriate movement of the screw drives 98, 99 the guides 70, 80 move toward and away from each other. Also, as shown in FIG. 4 and as discussed earlier with regard to FIG. 2, operation of the hydraulic actuator 34 causes overall movement of the guide 30 toward and away from the mill rollers 12*a*, 12*b*, the guide 30 having its lowermost end 19*c* riding upon tracks or ways 19*a*, 19*b* fixed in position relative to the mill floor 19, as shown in FIG. 4.

As earlier mentioned, and with specific reference to FIGS. 1 and 3, the movement of the guide 30 towards the mill rollers 12*a*, 12*b* is limited by the stop mechanisms 50. The stop mechanisms 50 include a wheel 52, a screw 54 and a stop 56 whereby manual rotation of the wheel 52 causes the screw 54 to advance or retract, adjusting the position of the stop 56. The stop 56 engages the frame 12*c* of the mill 12 to limit the closeness of the guide 30 to the mill rollers 12*a*, 12*b* (see FIG. 1). Therefore, by calibration of the stop mechanism, the precise distance between the guide 30 and the mill rollers 12*a*, 12*b* can be established, maintained and readily adjusted.

With further reference to FIGS. 2 and 4, the right or feed end of the guide 30 provides a relatively wide throat for initially receiving the leading edge of the material 20 as it is being fed into the nip 12*d*. Once the material has been threaded through and between the guides 70, 80 it can be supported at its outer edges by the bottom plates 76, 86 and at its middle by a center guide rail 130 having at its upper end an abrasion-resistant surface 130*a* of a material identical or similar to the earlier discussed abrasion-resistant material lining the guides 70, 80. It should be noted that during steady state operation, the material 20 is actually slightly spaced above the bottom plates 76, 86 and the center guide rail 130 wherein only the outer vertical edges of the material 20 engages the lower portions of the series of rollers 100, 110, 120 and 100*a*, 110*a*, 120*a*.

While vertical movement of the leading edge of the strip material 20 is controlled and guided by the upper and lower plates 72, 76 and 82, 86 of the guides 70, 80, horizontal or sideways movement is controlled and guided primarily by the series of rollers along the side walls 74, 84 of the guides. With specific reference to FIG. 3, it can be seen that the feed or front end of the guide 30 provides a throat for receiving the leading edge of the material 20 wherein the front end of the side walls 74, 84 are flared outwardly away from each other. It can also be seen that the rollers 120, 120*a* are of a diameter approximately twice the diameter of the downstream rollers 110, 110*a* and 100 and 100*a*. In accordance with the invention, the larger diameter rollers 120, 120*a* at the front or upstream end of the guide 30 are designed to accommodate higher impact forces experienced by these rollers, since they are often the first rollers to engage and forcibly guide the leading edge of the strip material. The rollers 120, 120*a* are the primary means for engaging and forcing the leading edge of the strip 20 into an alignment with the remaining rollers 100, 100*a* and 110, 110*a*. As noted earlier, during a steady state operation, only the side edges 20*a*, 20*b* of the material 20 are in contact with the series of rollers along the guides 70, 80 so as to minimize abrasion of the guides and also reduce frictional wear of the material 20 as it is worked.

As noted earlier, the material 20 is at high temperature when it is worked. To avoid overheating of the lower ends of the rollers engaging the side edges of the material, and thus degradation of the rollers, a plurality of spray nozzles 140 are provided, each being adjacent to a lower portion of the rollers (see FIGS. 3 and 4). A water-based cooling liquid is sprayed on the lower portions of the rollers during operation to reduce their temperature thereby minimizing roller surface degradation.

In accordance with the present invention, when the lower portions of the rollers 100–100*a*, 110–110*a*, 120–120*a* are worn to a predetermined degree, the rollers can be easily inverted whereupon the less-worn upper portions now primarily engage the edges of the material 20 so as to permit continued operation of the machine. The structure and mounting of the rollers facilitating such roller inversion will now be more clearly illustrated with regard to FIGS. 5, 6, and 7.

Figure 5:
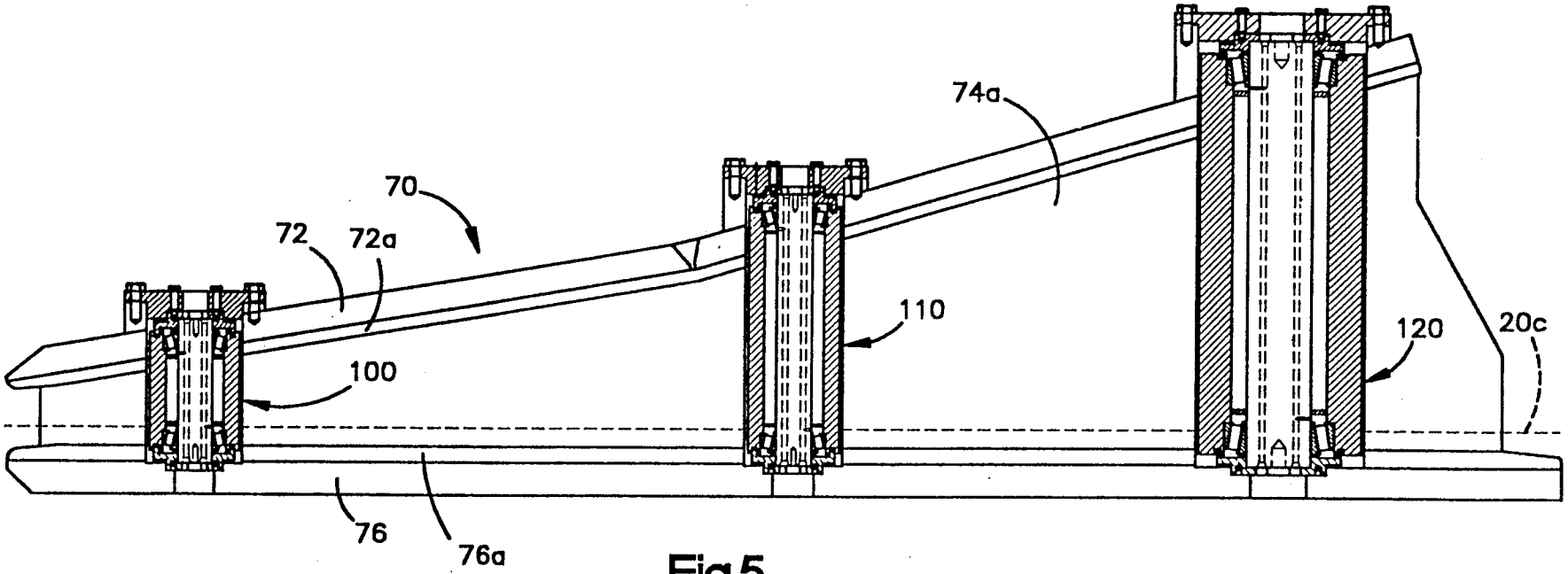
FIG. 5 is an elevation view in partial cross section of a right side guide element of the strip mill entry guide.

As shown in FIG. 5, roller 120 is of the largest diameter and as noted earlier, is farthest from the nip into which the material is being fed. The roller 120 is also of greatest length wherein the lengths of rollers 110, 100 decrease. This variation in length accommodates the decreasing vertical movement or oscillation of the leading edge of the material as it progresses from roller 120 then past roller 110 and finally past roller 100 before entering the nip. Also as shown in FIG. 5, line 20*c* illustrates the pass line of the strip material 20 when in a steady state operation of the guide and mill. Thus, for the most part, it is only the lower portions of the rollers that regularly engage the strip material 20. With specific reference to FIGS. 6 and 7, roller 120 is illustrated, it being recognized that the remaining rollers are of generally identical construction but for their dimensions. The roller 120 includes an outer cylindrical shell 150 of high strength material so as to provide for a relatively thin wall thickness. Thus, an element with low weight and low inertia is provided whereby the initial engagement of the edge of the material 20 with the outer surface of the shell 150 will cause the shell to rotate quickly, as opposed to the case where the shell 150 is of higher mass. Therefore, in accordance with the present invention, the weight of the shell 150 is minimized to the extent possible, preventing low inertia forces to the incoming sheet material and allowing the roller to accelerate to a given speed in a minimum amount of time, thus minimizing abrasion between the roller and the edge of the material as the roller comes up to speed upon engagement with the material.

The shell 150 is rotatably supported by a spindle member 152 that extends through the center of the shell 150 as shown. The spindle 152 is fixed in position and carries at its upper and lower ends appropriate roller bearings. More specifically, such bearings includes outer races 154, 154*a*, roller members 156, 156*a* and inner race members 158, 158*a*, as illustrated. Such bearing assemblies are commonly referred to as tapered roller bearing assemblies and their operation and structure is well known in the art. The outer surfaces of the outer races 154, 154*a* engage and are received into the ends of the shell 150 while the inner races 158, 158*a* fit over and engage the ends of the spindle 152. An upper roller cap 160 and a lower roller cap 160*a* capture the shell 150, the spindle 152 and the associated bearing assemblies between them. While the lower cap 160*a* is supported by the lower plate 76 of the guide, the upper cap 160 is held down in its position by an end plate 165 which in turn is fastened to a portion of the upper guide plate 72 by appropriate bolts 167, 168 as shown. The spindle 152 includes a network of longitudinal and transverse ports 152*a* through which lubricant is forced, the lubricant being diverted toward the upper and lower bearing assemblies by appropriate seal members 152*b*, 152*c*. Thus, pressurized lubricant continuously flows to a limited degree through the bearing assemblies to ensure proper lubrication at all times. Thus, the series of rollers along the guides 70, 80 as discussed earlier are constantly lubricated to ensure smooth operation and minimal bearing wear while also being cooled at their lower ends by the water-based spray nozzle network.

From the foregoing, it can be seen that an entry guide for a strip mill has been provided which is of simple yet rugged construction and which will provide accurate guiding of strip material into a set of mill rollers with minimal wear on both the guide and the strip material that it is handling due to the configuration and design of the guides including the associated series of rollers extending along such guides. Due to constant lubrication and cooling of the rollers, extended operation of the guide is possible so as to minimize downtime. Also, when the lower ends of the guide rollers have worn to a predetermined degree, the rollers can be easily inverted so as to provide the lesser worn upper surfaces for engagement with the edges of the material being rolled. When the former upper ends of the rollers are worn, the rollers can be disassembled and whereupon their outer shell portions can be replaced quickly and easily, thereby returning the guide mechanism to service.

It should be evident that this disclosure is by way of example and that various changes may be made by adding, modifying or eliminating details without departing from the fair scope of the teaching contained in this disclosure. The invention is therefore not limited to particular details of the disclosure, except to the extent that the following are necessarily so limited.

What is claimed is:

1. A mechanism for feeding strip material into a nip between a pair of strip mill rollers, said strip material being an elongated horizontally extending strip of indeterminate length, said strip having horizontal top and bottom surfaces, and vertical side edges, said mechanism comprising:

a frame structure movable toward and away from said rollers;

a pair of opposed horizontally extending guides mounted on said frame for engaging and capturing the vertical side edges of the strip material, said guides defining a horizontally extending channel that vertically tapers as said strip material moves through said channel toward said nip; and a series of vertical axis rollers mounted on and extending along a horizontal length of each guide, each vertical axis roller having an upper portion and a lower portion, the side edges of the material sequentially engaging and riding on primarily said lower portions of said vertical axis rollers as the material moves toward the nip, each vertical axis roller being of a vertical length substantially greater than an expected thickness of the strip material wherein, due to said engagement of said side edges primarily with the lower portions of the vertical axis rollers, said lower portions wear faster than said upper portions, said vertical axis rollers being invertible to allow wear of said upper portions subsequent to said wear of said lower portions.

2. A mechanism according to claim 1 wherein each of the vertical axis rollers have a length and are spaced a distance from the nip, the length of said rollers decreasing as their distance from said nip decreases.

3. A mechanism according to claim 1 wherein each of the vertical axis rollers have a diameter, the diameter of the vertical axis rollers farthest from the nip being greater than the diameter of the vertical axis rollers closest to the nip.

4. A mechanism according to claim 1 including means mounted on said frame for spraying cooling liquid on only said bottom portions of said vertical rollers.

5. A mechanism according to claim 1 including at least one manually adjustable stop mounted on said frame and engageable with a frame portion of said strip mill rollers to limit movement of said mechanism toward said strip mill rollers.

6. A mechanism for feeding strip material into a nip between a pair of strip mill rollers, said strip material being an elongated horizontally extending strip of indeterminate length, said strip having horizontal top and bottom surfaces, and vertical side edges, said mechanism comprising:

a frame structure movable toward and away from said rollers;

a pair of opposed horizontally extending guides mounted on said frame and simultaneously movable toward and away from each other to accommodate different widths of said strip material, said guides engaging and capturing the vertical side edges of the strip material, said guides each including a top plate, a bottom plate, and a sidewall, said plates and sidewalls defining a horizontally extending channel that vertically tapers as said strip material moves through said channel toward said nip, a distance between said top and bottom plates increasing as said top and bottom plates extend away from said nip; and a series of vertical axis rollers mounted on said guide and extending along a horizontal length of each sidewall, each vertical axis roller having an upper portion and a lower portion, the side edges of the material sequentially engaging and riding on primarily said lower portions of said vertical axis rollers as the strip material moves toward the nip, each vertical axis roller being of a vertical length substantially greater than an expected thickness of the strip material wherein, due to said engagement of said side edges primarily with the lower portions of the vertical axis rollers, said lower portions wear faster than said upper portions, said vertical axis rollers being invertible to allow wear of said upper portions subsequent to said wear of said lower portions.

7. A mechanism according to claim 6 wherein said sidewalls include first and second ends, said first ends being closest to said nip and said second ends being farthest from said nip, said sidewalls tapering away from each other at the ends farthest from said nip.

8. A mechanism according to claim 6 wherein said vertical axis rollers along said guides are of different lengths and diameters and are spaced different distances from said nip, vertical axis rollers spaced farthest from said nip having a diameter and length greater than vertical axis rollers closer to the nip.

* * * * *

UNITED STATES PATENT AND TRADEMARK OFFICE

CERTIFICATE OF CORRECTION

PATENT NO. : 5,220,819

DATED : June 22, 1993

INVENTOR(S) : William R. Scheib et al.

It is certified that error appears in the above-identified patent and that said Letters Patent is hereby corrected as shown below:

Column 1, line 33, delete "i".

Column 2, line 48, delete "13".

Column 4, line 16, delete "9": and line 58, after "during" insert --normal milling operations, the edges 20a, 20b (See FIG.--.

Column 9, Claim 4, line 3, after "vertical" insert --axis--.

Signed and Sealed this

Eighteenth Day of January, 1994

*Attest:*

Bruce Lehman

BRUCE LEHMAN

*Attesting Officer*

*Commissioner of Patents and Trademarks*